United States Patent [19]

Herron et al.

[11] Patent Number: 4,970,867

[45] Date of Patent: Nov. 20, 1990

[54] LIQUEFACTION OF NATURAL GAS USING PROCESS-LOADED EXPANDERS

[75] Inventors: D. Michael Herron, Fogelsville; Nirmal Chatterjee, Allentown, both of Pa.

[73] Assignee: Air Products and Chemicals, Inc., Allentown, Pa.

[21] Appl. No.: 396,577

[22] Filed: Aug. 21, 1989

[51] Int. Cl.[5] ..... F25J 3/00

[52] U.S. Cl. ..... 62/11; 62/40; 62/335

[58] Field of Search ..... 62/9, 11, 335, 40

[56] References Cited

U.S. PATENT DOCUMENTS

| | | | |
|---|---|---|---|
| 3,203,191 | 8/1965 | French | 62/9 |
| 3,400,547 | 9/1968 | Williams et al. | 62/55 |
| 3,645,106 | 2/1972 | Gaumer, Jr. et al. | 62/11 |
| 3,657,898 | 4/1972 | Ness et al. | 62/9 |
| 3,742,721 | 7/1973 | Bourguet et al. | 62/9 |
| 3,919,853 | 11/1975 | Rojey et al. | 62/9 |
| 4,065,278 | 12/1977 | Newton et al. | 62/40 |
| 4,274,849 | 6/1981 | Garier et al. | 62/40 |
| 4,334,902 | 6/1982 | Paradowski | 62/9 |
| 4,339,253 | 7/1982 | Caetani et al. | 62/9 |
| 4,404,008 | 9/1983 | Rentler et al. | 62/11 |
| 4,445,916 | 5/1984 | Newton | 62/40 |
| 4,456,459 | 6/1984 | Brundige | 62/9 |
| 4,525,185 | 6/1985 | Newton | 62/11 |
| 4,545,795 | 10/1985 | Liu et al. | 62/11 |
| 4,619,679 | 10/1986 | Delong | 62/11 |
| 4,755,200 | 7/1988 | Liu et al. | 62/11 |
| 4,778,497 | 10/1988 | Hanson | 62/11 |
| 4,809,154 | 2/1989 | Newton | 62/9 |

FOREIGN PATENT DOCUMENTS 54-86479 7/1979 Japan .

*Primary Examiner*—Ronald C. Capossela

*Attorney, Agent, or Firm*—John M. Fernbacher; James C. Simmons

[57] ABSTRACT

A process for the liquefaction of natural gas is disclosed wherein expansion valves for low-level multicomponent refrigerant and liquefied gas product streams are replaced with process-loaded turboexpanders having liquid inlet streams. Each turboexpander is coupled with a compressor or pump so that expansion work extracted from a given stream is used directly to compress or pump the stream prior to cooling and expansion. The use of process-loaded turboexpanders reduces the minimum work of liquefaction and increases the liquefaction capacity of the process.

15 Claims, 1 Drawing Sheet

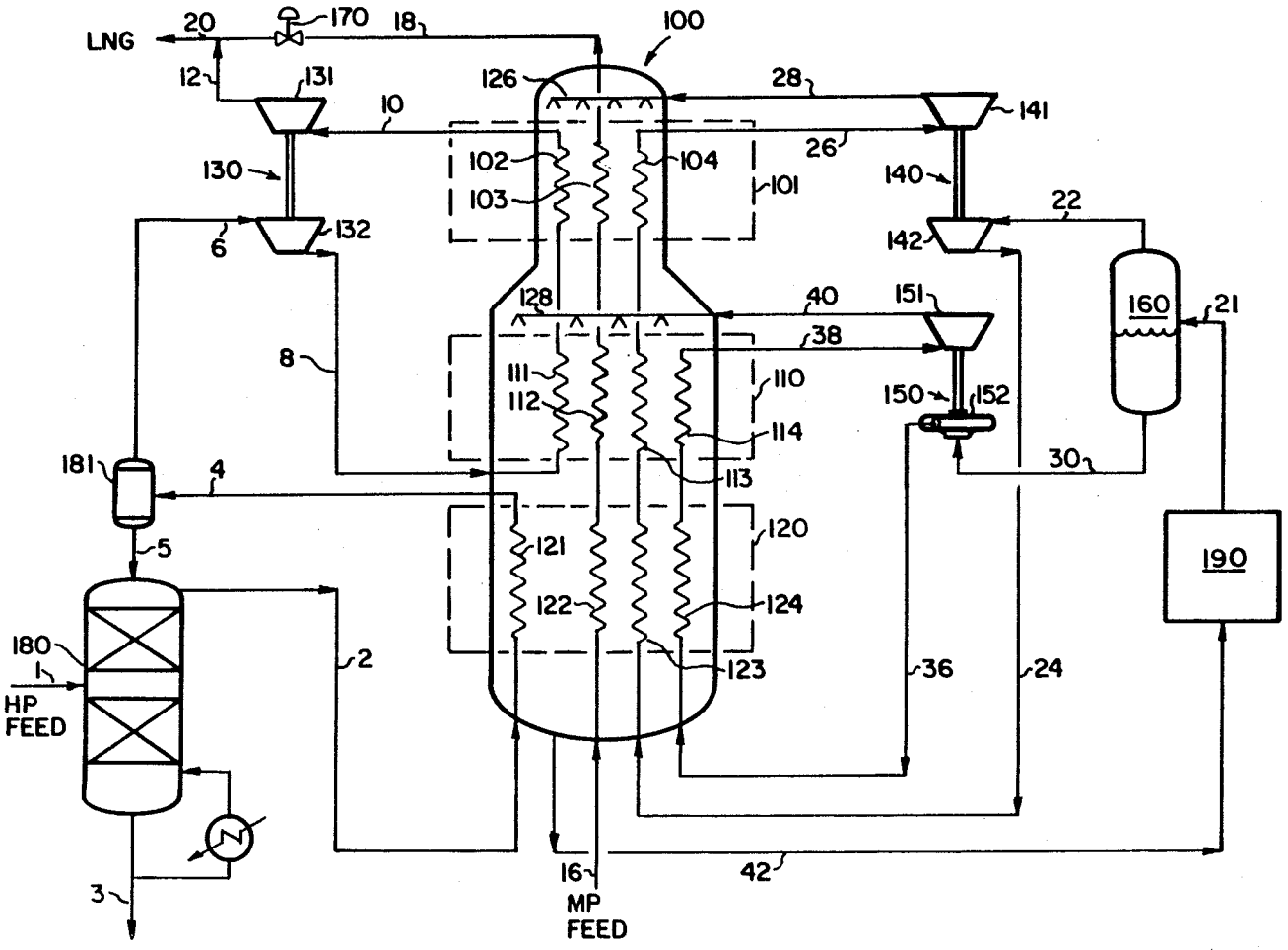
190
160
21
22
30
24
36
42
141
140
142
151
150
152
28
26
40
38
101
110
114
113
120
124
123
100
104
126
102
103
128
111
112
121
122
16
MP
FEED
18
10
170
131
132
130
8
2
20
12
6
4
5
LNG
181
180
HP
FEED
3

LIQUEFACTION OF NATURAL GAS USING PROCESS-LOADED EXPANDERS

TECHNICAL FIELD

This invention relates to a process for the liquefaction of natural gas which utilizes process-loaded liquid turboexpanders to improve process efficiency.

BACKGROUND OF THE INVENTION

The liquefaction of natural gas is an important and widely-practiced technology to convert the gas to a form which can be transported and stored readily and economically. The energy expended to liquefy the gas must be minimized to yield a cost-effective means of producing and transporting the gas from the gas field to the end user. Process technology which reduces the cost of liquefaction in turn reduces the cost of the gas product to the end user.

Process cycles for the liquefaction of natural gas historically have utilized isentropic expansion valves, or Joule Thomson (J-T) valves, to produce refrigeration required to liquefy the gas. Typical process cycles utilizing expansion valves for ths purpose are described for example in U.S. Pat. Nos. 3,763,658, 4,065,276, 4,404,008, 4,445,916, 4,445,917, and 4,504,296.

The work of expansion which is produced when process fluids flow through such valves is essentially lost. In order to recover at least a portion of the work produced by the expansion of these process fluids, expansion machines such as reciprocating expanders or turboexpanders can be utilized. Shaft work from such expansion machines can be used to generate electric power, to compress or pump other process fluids, or for other purposes. The use of such expanders to expand saturated or subcooled liquid process streams can be beneficial to overall process efficiency under selected conditions. The term "expander" is generally used to describe turborexpanders or reciprocating expanders. In the field of natural gas liquefaction, the term "expander" is usually used to denote a turboexpander, and is so used in the present disclosure.

U.S. Pat. No. 3,205,191 discloses the use of a hydraulic motor comprising a Pelton wheel to expand a subcooled liquefied natural gas stream prior to isentropic expansion through a valve. Conditions are controlled such that no vaporization occurs in the hydraulic motor expander. The expander work can be used for example for driving one or more compressors in the disclosed liquefaction process.

In U.S. Pat. No. 3,400,547, a process is disclosed wherein the refrigeration in liquid nitrogen or liquid air is utilized to liquefy natural gas at a field site for transportation by cryogenic tanker to a delivery site. At the delivery site, the liquefied natural gas is vaporized and the refrigeration so produced is utilized to liquefy nitrogen or air, which is transported by tanker back to the field site where it is vaporized to provide refrigeration to liquefy another tanker load of natural gas. At the field site, subcooled liquefied natural gas is expanded and the expansion work is used to pump liquid nitrogen or air from the tanker. At the delivery site, pressurized liquid nitrogen or air is expanded and the expansion work is used to pump liquefied natural gas from the tanker.

A process to produce liquid air by utilizing refrigeration from the vaporization of liquefied natural gas is disclosed in Japanes Patent Publication No. 54(1976)-86479. In the process, saturated liquid air is expanded in an expansion turbine, and the expansion work is used to compress feed air for initial liquefaction.

U.S. Pat. No. 4,334,902 discloses a process to liquefy a compressed natural gas stream by indirect heat exchange with a vaporizing multicomponent refrigerant in a cryogenic heat exchanger. Precooled two-phase refrigerant is separated into a liquid and a vapor stream; the liquid is further cooled in the cryogenic heat exchanger, expanded in a turboexpander, and introduced into the exchanger where it vaporizes to produce refrigeration; and the vapor stream is further cooled and liquefied in the exchanger, expanded in a turboexpander, and introduced into the exchanger where it vaporizes to produce additional refrigeration. Natural gas at 45 bar is passed through the exchanger, liquefied by indirect heat exchange, and expanded in a turboexpander to about 3 bar to produce liquefied natural gas product. The expansion work of the liquid turboexpanders is used to generate electric power or for other unspecified purposes. Additional refrigeration cycles are disclosed for precooling the refrigerant discussed above, and these cycles also use liquid expanders in which the expansion work is used to generate electric power or for other unspecified purposes.

The use of a turboexpander for the expansion of a liquefied natural gas stream prior to final flash step is disclosed in U.S. Pat. No. 4,456,459. The expansion prior to flash increases the yield of liquefied natural gas product and reduces the amount of flash gas. Work produced by the turboexpander may be usefully employed in the facility to operate various power-driven components through suitable shaft coupled compressors, pumps, or generators.

U.S. Pat. No. 4,778,497 discloses a gas liquefaction process in which a gas is compressed and cooled to produce a cold, high-pressure fluid which is further cooled to produce a cold supercritical fluid. A portion of the cold high-pressure fluid is expanded to provide further cooling and the expansion work is utilized for a portion of the compression work in compressing the gas prior to cooling. The cold supercritical fluid is further cooled and is expanded in an expander without vaporization to yield a final liquid product. A portion of this liquid product is flashed to provide refrigeration for the further cooling of the cold supercritical fluid.

The use of expansion work in a refrigeration or gas liquefaction process to drive pumps or compressors in the same process can improve the efficiency of the process. The optimum integration of expansion work with compression work to yield the greatest overall reduction in capital and operating costs in a given gas liquefaction process depends upon a number of factors. Among these factors are the compositions and thermodynamic properties of the process streams involved as well as mechanical design factors associated with compressors, pumps, expanders, and piping. The present invention as described in the following disclosure allows the improved utilization of expansion work in a process for the liquefaction of natural gas.

BRIEF DESCRIPTION OF THE DRAWING

The single Drawing is a schematic flowsheet for the process of the present invention including the integration of three process expanders with a pump and two compressors.

SUMMARY OF THE INVENTION

The invention is a process for liquefying a pressurized gaseous feedstream, such as natural gas, in which a portion of the refrigeration is provided by expanding at least one liquid process stream and utilizing the resulting expansion work to compress or pump the same process stream prior to cooling and expansion. The utilization of expansion work in this manner reduces the minimum work of liquefaction and increases the liquefaction capacity of the process.

In a natural gas liquefaction process in which a pressurized feedstream is liquefied in a cryogenic heat exchanger by indirect heat exchange with one or more vaporizing multicomponent refrigeration streams, several liquid streams are optionally expanded in process-loaded expanders according to the present invention to yield improvements in liquefaction process performance. The first of these streams is the pressurized natural gas feedstream, which is compressed, cooled and liquefied in the cryogenic heat exchanger, and expanded to yield a final liquefied product. Expansion work from the expander drives the compressor; the expander and compressor are mechanically linked in a single compander unit. Further, a multicomponent liquid refrigerant stream optionally is expanded before providing a major portion of refrigeration by vaporization within the cryogenic heat exchanger, and the work of expansion is utilized to compress the same refrigerant stream, which is initially a vapor, prior to liquefaction and expansion. The expander and compressor are mechanically linked in a single compander unit. A second multicomponent liquid refrigerant stream optionally is expanded prior to providing another major portion of refrigeration by vaporization within the cryogenic heat exchanger, and the work of expansion is utilized to pump the same liquid refrigerant stream prior to subcooling and expansion. The expander and pump are mechanically linked in a single expander/pump unit.

The cooling and liquefaction of the process feedstream and refrigerant streams, prior to expansion, by indirect heat exchange with the vaporizing refrigerant streams are carried out in a cryogenic heat exchanger which comprises a plurality of coil-wound tubes within a vertical vessel and means for distributing liquid refrigerant which flows downward and vaporizes over the outer surfaces of the tubes. Vaporized refrigerant from the exchanger is compressed, cooled and partially liquefied by an external refrigeration system, and returned to provide the vapor refrigerant stream which is compressed and the liquid refrigerant stream which is pumped as earlier described.

The application of the present invention improves the efficiency and reduces the power consumption of the gas liquefaction process, or alternately increases liquefaction capacity for a constant power consumption.

It is a feature of the invention that the expansion work of each expander is utilized by direct mechanical coupling to drive a liquid pump or gas compressor which is also a part of the liquefaction process cycle. Each expander operates on the same process stream as does the coupled machine in order to increase process efficiency and reliability, and decrease capital cost.

By using liquid expanders coupled with a pump and compressors in the manner of the present invention for the liquefaction of natural gas, an advantage of a 6.3% reduction in total process compression power can be realized over a similar process utilizing isentropic expansion valves instead of process-loaded liquid expanders. Conversely, for constant process compressor power, the present invention can increase liquefaction capacity by 6.3% over the corresponding process using isentropic expansion valves alone. The use of the expansion work to drive the pump and compressors in the present invention yields a 1.5% increase in liquefaction capacity compared with the use of the expansion work for other purposes such as electric power generation.

DETAILED DESCRIPTION OF THE INVENTION

Liquefied natural gas (LNG) is produced from a methane-containing feedstream typically comprising from about 60 to about 90 mole % methane, heavier hydrocarbons such as ethane, propane, butane, and some higher molecular weight hydrocarbons, and nitrogen. The methane-containing feedstream is compressed, dried, and precooled in a known manner, for example, as disclosed in U.S. Pat. No. 4,065,278, the specification of which is incorporated herein by reference. This compressed, dried, and precooled gas comprises the natural gas feedstream to the process of the present invention.

Referring now to the single Drawing, previously cooled, dried, and compressed natural gas feedstream 1 at a pressure between about 400 and 1,200 psig and between about 20° and −30° F. is passed into scrub column 180 in which hydrocarbons heavier than methane are removed in stream 3. Methane-rich stream 2 passes through heat exchange element 121 and is partially condensed. Stream 4 containing vapor and liquid passes to separator 181 where liquid stream 5 is separated and provides reflux to scrub column 180. Removal of heavy hydrocarbons by such a scrub column is known in the art and is described for example in earlier-cited U.S. Pat. No. 4,065,278. Other scrub column arrangements can be used depending upon feed composition and process conditions. If feedstream 1 contains a sufficiently low concentration of heavier hydrocarbons, scrub column 180 is not needed. Stream 6, now containing typically about 93 mole % methane at about 630 psig and −45° F., is compressed in compressor 132 to about 675 psig thus yielding natural gas feedstream 8. This stream flows through heat exchanger element 111 in middle bundle 110 and element 102 in cold bundle 101 to yield subcooled liquefied natural gas stream 10 at about 580 psig and about −255° F. Stream 10 is expanded in expander 131 to reduce its pressure from about 580 psig to about 0 psig, and sent as stream 12 to final LNG product 20. Expander 131 drives compressor 132, and these are mechanically linked as compander 130.

Additional methane-containing feed at a pressure between about 300 and 400 psig as stream 16 optionally can be liquefied by flowing through heat exchange elements 122, 112, and 103, to yield additional liquefied natural gas stream 18 at about 200 to 300 psig and about −255° F. Stream 18 is expanded across valve 170 and combined with stream 12 to yield final product 20. This additional feed can be obtained from elsewhere in the process cycle or from an external source.

Refrigeration for liquefying the natural gas as described above is provided by vaporizing a low level multicomponent refrigerant (LL MCR) on the shell side of cryogenic heat exchanger 100. LL MCR stream 21 is provided by compressing and cooling vaporized MCR in external closed-loop refrigeration system 190 such as that disclosed in previously-cited U.S. Pat. No.

4,065,278. Refrigeration for cooling the external MCR circuit is provided by a second, higher-temperature closed-loop refrigeration system as described in that patent. LL MCR stream 21, now partially liquefied, passes into separator 160 at typically about 565 psig and between about 20° and −40° F. MCR vapor stream 22 is compressed to about 595 psig in compressor 142 and compressed stream 24 at between 30° and −30° F. enters cryogenic heat exchanger 100. The stream passes through heat exchanger elements 123, 113, and 104, and emerges as liquid stream 26 at typically about 465 psig and −255° F. Liquid stream 26 is expanded in expander 141 to about 30 psig −265° F., and the resulting stream 28 contains up to 6% vapor. Expander 141 and compressor 142 are mechanically linked as compressor 142. Cooled MCR stream 28 is introduced into cryogenic heat exchanger 100 through distributor 126, and flows over the outer surface of the heat exchange elements while vaporizing in cold bundle 101, middle bundle 110, and warm bundle 120. Liquid MCR stream 30 from separator 160 is pumped by pump 152 to about 975 psig, and the resulting stream 36 flows into cryogenic heat exchanger 100 and through heat exchange elements 124 and 114. Liquefied MCR stream 38, now at about 865 psig and −200° F., is expanded in expander 151 to about 30 psig, cooling the stream to about −205° F. Expander 151 and pump 152 are mechanically linked as expander/pump unit 150, and expansion work from expander 151 drives pump 152. Expanded MCR stream 40 enters cryogenic heat exchanger 100 and is distributed over the heat exchange elements by distributor 128. Liquid MCR flows downward over the heat exchange elements in middle bundle 110 and warm bundle 120 while vaporizing to provide refrigeration to cooling streams therein. Vaporized MCR stream 42 returns to the closed-loop refrigeration system 190 to be compressed and cooled as earlier described.

Typically shell-side temperatures in cryogenic heat exchanger 100 range from −275° to −250° F. at the top of cold bundle 101, −220° to −190° F. at the top of middle bundle 110, and −100° to −40° F. at the top of warm bundle 120. The multicomponent refrigerant (MCR) utilized for cooling the shell side of cryogenic heat exchanger 100 comprises a mixture of nitrogen, methane, ethane, and propane. For the embodiment of the present invention, a specific mixture of 5.8 mole % nitrogen, 35.8% methane, 44.0% ethane, and 13.4% propane is used. Variations of this composition and these components can be used depending upon the natural gas feedstream composition and other factors which affect the liquefaction process operation.

The improvement of the present invention over prior art processes for natural gas liquefaction is the replacement of isentropic expansion valves with expanders to provide refrigeration to cryogenic heat exchanger 100 and for final pressure letdown of the LNG product, and the additional compression of the multicomponent refrigerant vapor in compressor 142 prior to cooling and liquefaction by utilizing the expansion work produced by expanding this liquefied stream in expander 141. Further, the improvement includes pumping the liquid multicomponent refrigerant in pump 152 prior to subcooling by utilizing the expansion work produced by the expansion of this subcooled liquid in expander 151. Another key feature of the present invention is the utilization of the expansion work from the LNG product final pressure letdown in expander 131 for the compression of cold vapor feed in compressor 132 before entering the cryogenic heat exchanger 100. By replacing isentropic expansion valves with expanders, additional refrigeration can be obtained and liquefaction capacity increased. In the present invention, by utilizing the expansion work to compress or pump warmer process streams, the minimum work of liquefaction can be reduced and the liquefaction capacity further increased.

EXAMPLE

In order to determine the advantages of the present invention, a comparative computer simulation of an entire LNG process cycle was carried out. The cycle includes the high level and the low level multicomponent refrigeration loops earlier described as well as the cryogenic heat exchanger circuit shown in the Drawing. A Base Case is selected in which isentropic expansion valves are utilized instead of expanders 131, 141 and 151 of the Drawing, and in which compressor 132, compressor 142, and pump 152 are not utilized. An Expander Case has been simulated in which expanders 131, 141 and 151 are utilized without compressor 132, compressor 142, and pump 152. These cases are compared with the process cycle of the present invention given in the Drawing. Feed and process conditions for an actual commercial LNG plant with a design capacity of $320\times10^6$ standard cubic feet per day are used in the comparative simulation.

A comparison of process power requirements for the three cases is summarized in Table 1.

TABLE 1

| | Base Case | Expander Case | Present Invention |
|---|---|---|---|
| Compression Power, HP | | | |
| LL MCR Refrigeration Circuit | 80,426 | 76,017 | 74,459 |
| High Level Refrigeraton Circuit | 39,440 | 38,086 | 37,897 |
| Total | 119,866 | 114,103 | 112,356 |
| % Power Reduction Over Base Case or % Production Increase at Constant Power | 0.0 | 4.8 | 6.3 |
| Expander/Compressor Power, HP | | | |
| MCR Vapor | | | |
| (Compressor 142) | — | — | 258 |
| (Expander 141) | — | 281 | 276 |
| MCR Liquid | | | |
| (Pump 152) | — | — | 1,462 |
| (Expander 151) | — | 802 | 1,509 |
| LNG | | | |
| (Compressor 132) | — | — | 723 |
| (Expander 131) | — | 679 | 736 |

As illustrated in Table 1, the use of expanders 131, 141, and 151 in place of expansion valves yields a 4.8% decrease in process compression power, or conversely allows a 4.8% increase in LNG production at constant compression power. In the present invention the use of process-loaded expanders to drive compressors 132 and 142 and pump 152 yields an additional 1.5% decrease in power or a 1.5% increase in LNG production at constant compression power. This additional 1.5% increase is achieved in two ways. First, more refrigeration can be produced as compared with the Expander Case because the suction pressure of each expander is higher, and the expansion ratios are thus higher. This is most pronounced in this Example for the multicomponent refrigerant expander 151 of the present invention, for which the refrigeration effect is 87% higher than in the Expander Case in which pump 152 is not used. This is so because the pressure of stream 38 is increased from about 565 psig to 975 psig by pump 152, and the stream is expanded from 865 psig to about 30 psig, as compared with expanding the stream from only 455 psig to about 30 psig across an expansion valve. Second, because the two streams 24 and 36 are condensed and subcooled in cryogenic heat exchanger 100 at a higher pressure than in the Expander Case, the minimum work of liquefaction is reduced. The multicomponent refrigerant pressure thus can be raised, which in turn raises the suction pressure of the refrigerant compressors, which in turn reduces specific power. Alternatively, the LNG liquefaction product capacity can be increased at constant process compressor power for the Example summarized in Table 1.

In the present invention, each expander drives a pump or compressor as illustrated in the Figure by companders 130 and 140, and by expander/pump 150. A unique feature of the present invention, as pointed out earlier, is that each expander is process-loaded on the same fluid; expander 131 and compressor 132 both operate on the natural gas feed/product, expander 141 and compressor 142 both operate on the multicomponent refrigerant vapor/condensate, and expander 151 and pump 152 both operate on multicomponent refrigerant liquid. Table 1 shows that expander 141 generates 276 HP, of which (after machinery inefficiencies) 258 HP is used to compress stream 22 in compressor 142. This amount of work would have been lost if an expansion valve had been used in place of expander 141. Similarly, about half of the 1462 HP driving pump 152 and the 723 HP driving compressor 132 would have been lost if expansion valves had been used in place of expanders 131 and 151.

The work generated by expanders 131, 141, and 151 in the Expander Case is used to generate electric power so that most of the work otherwise lost in the Base Case of Table 1 is recovered. It is generally more desirable, however, to utilize the work from expanders 131, 141, and 151 directly in coupled process machines as in the present invention to allow an increase in LNG production for given compressors and power consumption, because at a typical remote LNG plant site, additional LNG product is usually economically preferable over additional electric power for use within the plant or for export.

The choice of where to utilize the work generated by such process-loaded expanders is an optimum balance between operating efficiency and capital cost. This balance was evaluated by carrying out additional computer simulations of various process options to utilize the expander work generated by expanders 131, 141, and 151. Simulations showed that the greatest power savings are realized by using the work from these expanders to drive the main natural gas feed compressor upstream of the feed drying and precooling steps earlier described. However, there are some disadvantages to this approach: (1) the means for combining the three expanders and the compressor into a single machine would be complex and high in capital cost; and (2) the natural gas feed line would have to pass from the feed drier to exchanger 100 and back to the feed precooling system. The pressure drop and heat leak associated with this arrangement was deemed likely to offset any process efficiency gains realized. The process-loaded expander arrangement of the present invention thus was selected as the most cost-effective option to utilize expansion work for improving the overall efficiency of the natural gas liquefaction process.

We claim:

1. A process for liquefying a pressurized gaseous feedstream comprising the steps of:

(a) compressing said pressurized gaseous feedstream in a first compressor from a first pressure to a second pressure to yield a compressed feedstream;

(b) cooling and liquefying said compressed feedstream by indirect heat exchange with a first and a second vaporizing multicomponent refrigerant stream in a cryogenic heat exchanger;

(c) expanding the resulting liquefied feedstream of step (b) in a first expander wherein expansion work from said first expander drives said first compressor; and (d) withdrawing a liquefied gas product from said first expander;

whereby the utilization of the expansion work of said first expander to drive said first compressor allows the liquefaction of said feedstream at said second pressure, which reduces the minimum work of liquefaction per unit volume of said feedstream compared with the liquefaction of said feedstream at said first pressure, and thus increases the liquefaction capacity of said process for a fixed refrigeration compressor power to generate said first and second multicomponent refrigerant streams.

2. The process of claim 1 wherein said first vaporizing multicomponent refrigerant stream is provided by the steps of:

(1) compressing, cooling, and partially liquefying a gaseous multicomponent refrigerant mixture;

(2) separating the resulting partially liquefied multicomponent refrigerant mixture of step (1) into a vapor stream and a liquid stream;

(3) compressing said vapor stream in a second compressor to yield a compressed vapor stream;

(4) cooling and liquefying said compressed vapor stream by indirect heat exchange with said first and second vaporizing refrigerant streams in said cryogenic heat exchanger; and (5) expanding the resulting liquefied stream of step (4) in a second expander and introducing the expanded stream into said cryogenic heat exchanger to provide said second vaporizing multicomponent refrigerant stream, wherein expansion work from said second expander drives said second compressor.

3. The process of claim 2 wherein said second vaporizing multicomponent refrigeration stream is provided by the additional steps of:

(6) pumping said liquid stream of step (2) in a pump and cooling the pumped stream by indirect heat exchange with said first and second vaporizing refrigerant streams in said cryogenic heat exchanger;

(7) expanding said pumped liquid stream of step (6) in a third expander and introducing the expanded stream into said cryogenic heat exchanger to provide said first vaporizing multicomponent refrigerant stream, wherein expansion work from said third expander drives said pump; and (8) withdrawing vaporized multicomponent refrigerant from said cryogenic heat exchanger and repeating step (1).

4. The process of claim 1 wherein said pressurized gaseous feedstream is obtained by removing $C_2$ and heavier hydrocarbons from a precooled, dried, and compressed natural gas stream, cooling and partially liquefying the resulting methane-rich stream by indirect heat exchange with said vaporizing refrigerant in said cryogenic heat exchanger, and separating the resulting two-phase stream to yield said pressurized gaseous feedstream and a liquid stream, wherein said liquified gas product comprises liquid methane.

5. The process of claim 4 further comprising liquefying a methane-containing pressurized gas stream by indirect heat exchange with said first and second vaporizing multicomponent refrigerant streams in said cryogenic heat exchanger and expanding the resulting liquefied stream, thereby providing additional liquid methane product to be combined with the product from said first expander.

6. The process of claim 1 wherein said multicomponent refrigerant comprises nitrogen, methane, ethane, and propane.

7. A closed-loop process to provide refrigeration for the liquefaction of a gaseous feedstream comprising the steps of:

(a) compressing, cooling, and partially liquefying a gaseous multicomponent refrigerant mixture;

(b) separating said partially liquefied refrigerant into a vapor stream and a liquid stream;

(c) compressing said vapor stream;

(d) cooling and liquefying said compressed vapor stream by indirect heat exchange with a first and a second vaporizing refrigerant stream in a cryogenic heat exchanger;

(e) expanding said liquefied stream of step (d) and introducing the expanded stream into said cryogenic heat exchanger to provide said second vaporizing multicomponent refrigerant stream, wherein the expansion work is utilized for the compression of said vapor stream in step (c);

(f) pumping said liquid stream of step (b) and cooling the pumped stream by indirect heat exchange with said first and second vaporizing refrigerant streams in said cryogenic heat exchanger;

(g) expanding said pumped and cooled liquid stream of step (f) and introducing the expanded stream into said cryogenic heat exchanger to provide said first vaporizing multicomponent refrigerant stream, wherein the expansion work is utilized for the pumping of said liquid stream in step (f); and (h) withdrawing vaporized multicomponent refrigerant from said cryogenic heat exchanger and repeating step (a);

wherein a portion of the refrigeration provided by said vaporizing multicomponent refrigerant streams in said cryogenic heat exchanger is utilized therein to liquefy said gaseous feedstream by indirect heat exchange, whereby the utilization of said expansion work to compress said vapor stream and pump said liquid stream increases the amount of refrigeration produced for a given power consumption in said process.

8. A system for the liquefaction of a pressurized gaseous feedstream by indirect heat exchange with vaporizing multicomponent refrigerant comprising;

(a) heat exchange means comprising a plurality of coil-wound tubes within a vertical vessel having a top end and a bottom end, including means for entry and exit of said tubes through the shell of said vessel;

(b) means for distributing a first liquid multicomponent refrigerant stream at the top end of said vessel, whereby said first liquid refrigerant stream flows downward over the outer surfaces of said tubes and vaporizes to provide refrigeration to fluids flowing within said tubes;

(c) means for distributing a second liquid multicomponent refrigerant stream at a point intermediate the top end and bottom end of said vessel, whereby said second liquid refrigerant stream flows downward over a portion of the outer surfaces of said tubes and vaporizes to provide additional refrigeration to fluids flowing within said tubes; and (d) a first centrifugal compressor mechanically coupled to a first turboexpander, wherein said pressurized gaseous feedstream is further compressed, and after liquefaction by cooling in a first group of said coil-wound tubes is expanded in said first turboexpander to provide a liquefied gas product, whereby expansion work from said first turboexpander drives said first compressor.

9. The system of claim 8 further comprising:

(e) means for transporting vaporized multicomponent refrigerant from the bottom of said vessel;

(f) compression and cooling means to liquefy partially said vaporized multicomponent refrigerant;

(g) separator means to separate said partially liquefied refrigerant into a vapor and a liquid stream; and (h) a second centrifugal compressor mechanically coupled to a second turboexpander, wherein said vapor stream is compressed and after liquefaction by cooling in a second group of said coil-wound tubes is expanded in said second turboexpander to provide said first liquid multicomponent refrigerant stream, whereby expansion work from said second turboexpander drives said second compressor.

10. The system of claim 9 further comprising:

(i) a centrifugal pump mechanically coupled to a third turboexpander wherein said liquid stream is pumped, and after further cooling in a third group of said coil-wound tubes is expanded in said third turboexpander to provide said second liquid multicomponent refrigerant stream, whereby expansion work from said third turboexpander drives said pump.

11. The system of claim 8 wherein said heat exchange means includes a fourth group of said coil-wound tubes and an expansion valve, in which another pressurized gaseous feedstream is liquefied and expanded to produce additional liquefied gas product.

12. The system of claim 9 further comprising a distillation system for removing $C_2$ and heavier hydrocarbons from a precooled, dried, and pressurized natural gas stream, wherein the vapor product from said distillation system provides said pressurized gaseous feedstream to said first compressor, and a fifth group of coil-wound tubes in said heat exchange means to provide reflux for said distillation system by partially liquefying a vapor stream from said system.

13. A closed-loop process to provide refrigeration for the liquefaction of a gaseous feedstream comprising the steps of:

(a) compressing, cooling, and partially liquefying a gaseous multicomponent refrigerant mixture;

(b) separating the resulting partially liquefied refrigerant of step (a) into a vapor stream and a liquid stream;

(c) compressing said vapor stream;

(d) cooling and liquefying the resulting compressed vapor stream of step (c) by indirect heat exchange with a first and a second vaporizing multicomponent refrigerant stream in a cryogenic heat exchanger;

(e) expanding the resulting liquefied stream of step (d) and introducing the expanded stream into said cryogenic heat exchanger to provide said second multicomponent vaporizing refrigerant stream, wherein the expansion work is utilized for the compression of said vapor stream in step (c); and (f) withdrawing vaporized multicomponent refrigerant from said cryogenic heat exchanger and repeating step (a);

wherein a portion of the refrigeration provided by said vaporizing multicomponent refrigerant streams in said cryogenic heat exchanger is utilized therein to liquefy said gaseous feedstream by indirect heat exchange, whereby the utilization of said expansion work to compress said vapor stream increases the amount of refrigeration produced for a given power consumption in said process.

14. A closed-loop process to provide refrigeration for the liquefaction of a gaseous feedstream comprising the steps of:

(a) compressing, cooling, and partially liquefying a gaseous multicomponent refrigerant mixture;

(b) separating the resulting partially liquefied refrigerant of step (a) into a vapor stream and a liquid stream;

(c) pumping said liquid stream of step (b) and cooling the pumped stream by indirect heat exchange with said first and second vaporizing multicomponent refrigerant streams in said cryogenic heat exchanger;

(d) expanding the pumped and cooled liquid stream of step (c) and introducing the expanded stream into said cryogenic heat exchanger to provide said first vaporizing multicomponent refrigerant stream, wherein the expansion work is utilized for the pumping of said liquid stream in step (c); and (e) withdrawing vaporized multicomponent refrigerant from said cryogenic heat exchanger and repeating step (a);

wherein a portion of the refrigeration provided by said vaporizing multicomponent refrigerant streams in said cryogenic heat exchanger is utilized therein to liquefy said gaseous feedstream by indirect heat exchange, whereby the utilization of said expansion work to pump said liquid stream increases the amount of refrigeration produced for a given power consumption in said process.

15. The process of claim 1 wherein said pressurized gaseous feedstream is natural gas.

* * * * *